United States Patent [19]

Olsen

[11] Patent Number: 4,607,471

[45] Date of Patent: Aug. 26, 1986

[54] PANEL WALL SYSTEM

[75] Inventor: Robert W. Olsen, New Providence, N.J.

[73] Assignee: Construction Specialties, Inc., Cranford, N.Y.

[21] Appl. No.: 669,582

[22] Filed: Nov. 8, 1984

[51] Int. Cl.[4] ..... E04B 1/38

[52] U.S. Cl. ..... 52/509; 52/549

[58] Field of Search ..... 52/509, 520, 527, 533, 52/536, 544, 548, 549, 535, 539, 235

[56] References Cited

U.S. PATENT DOCUMENTS

| | | | |
|---|---|---|---|
| 1,126,638 | 1/1915 | Jager | 52/533 X |
| 3,686,813 | 8/1972 | Breitwieser | 52/549 X |
| 3,858,375 | 1/1975 | Silvernail | 52/235 |

*Primary Examiner*—William F. Pate, III

*Assistant Examiner*—Creighton Smith

*Attorney, Agent, or Firm*—Brumbaugh, Graves, Donohue & Raymond

[57] ABSTRACT

A building panel wall assembly comprises a multiplicity of pan-like rectangular panels arranged side by side and end to end in closely spaced relation. Each panel has an L-shaped top flange and a bottom flange and side flanges that extend in from the principal wall of the panel toward the building structure. A drainage gutter extends vertically along the vertical junctures between laterally adjacent panels. Either the upper or the lower flange of each panel is fastened to the building structure, and one or more clips connect the upper flange of each panel to the lower flange of the panel above it in the manner of a slip joint to allow relative movement in a plane parallel to the principal wall.

9 Claims, 5 Drawing Figures

PANEL WALL SYSTEM

FIELD OF THE INVENTION

The present invention relates to a panel wall system and, in particular, a wall cladding system that is especially suitable for use in commercial and industrial buildings.

BACKGROUND OF THE INVENTION

There are, of course, many ways of finishing the exteriors of commercial and industrial buildings. One type of external wall system utilizes individual prefabricated panels that are suitably fastened to the building framing, ordinarily by a relatively lightweight retaining system to which the panels can readily be attached and by which the panels are joined to the main building framing. Within this general type of exterior panel wall system are some commercially available versions that utilize composite panels composed of thin aluminum sheets laminated to a plastic core. These composite panels fit into a frame work made up of retainers having grooves that receive the edges of the panels.

These previously known panel systems based on aluminum/plastic/aluminum composite panels have several disadvantages. For one thing the framing system ordinarily requires that the panels and retainers be installed in step, panel by panel and retainer by retainer, working horizontally and vertically, inasmuch as the system depends upon reception of the panel edges in channels or tracks of the retainers. Thus, after a panel is installed, the retainer tracks for the then free edges of the panel are installed and so forth. As far as installation costs are concerned, the assembly procedure is relatively inexpensive and can be accomplished relatively quickly. On the other hand, there is a distinct disadvantage that any panels that might be damaged during the life of the building are difficult to replace. Moreover, the composite panels have shown a tendency to delaminate because of deterioration of the adhesives due to the effect of moisture that attacks the edges where they fit into the retainers.

An exterior building wall panel system should protect the building structure from intrusion of water but also allow the wall to breathe. These two desired characteristics conflict to some degree and are difficult to attain with relatively large panels, because thermal expansion and contraction of the panels is hard on any sealing system. It is quite possible that seals will leak, sometimes as a result of careless installation or, perhaps more commonly, as a result of wear and tear from hundreds or thousands of thermal cycles over a period of years. Water intrusion behind the panel faces due to condensation is inevitable under certain weather conditions.

Construction Specialties, Inc. ("C/S"), the assignee of the present invention, has previously developed and commercialized a wall panel system under the trademark "Techwall" that has numerous advantages over the ones described generally above. Reference may be made to Goertner U.S. patent application Ser. No. 458,540, filed Jan. 17, 1983, and entitled "Panel Wall System" and Bartlett et. al. application Ser. No. 507,715, filed June 23, 1983, and entitled "Panel Wall System", now U.S. Pat. No. 4,506,484, issued Mar. 26, 1985 for a complete description of the prior art C/S "Techwall" system. The "Techwall" system employs vertical and horizontal retainers that are fastened to the building structure and to which panlike rectangular panels are fastened by clips received in slots in the peripheral flanges and fastened to the retainers. The Goertner application is directed to the panel form and the fastening arrangement. The Bartlett et. al. patent discloses a system that employs the concepts of the Goertner panels and fastener clips and provides for water control and drainage and to adapt the Goertner system to the "rain screen" principle of building construction. The "Techwall" system fulfills the objectives referred to above of protecting the building from water intrusion while allowing the wall to breathe and also provides for control and drainage of any water that penetrates the panel facade.

SUMMARY OF THE INVENTION

There is provided, in accordance with the present invention, a building panel wall assembly comprising a multiplicity of pan-like rectangular panels arranged side by side and end to end in closely spaced relation, each panel having a principal wall constituting a portion of the exterior building wall, a side flange along each side edge of the principal wall extending toward the building structure, a bottom flange along the bottom edge of the principal wall extending toward the building structure and a generally L-shaped top flange along the upper edge of the principal wall and including a first leg portion extending from the principal wall toward the building structure and a second leg portion extending upwardly from the first leg portion.

Either the top flange of the lower panel of the pair or the bottom flange of the upper panel of the pair is affixed to the building structure. The bottom flange of the upper panel is joined to the top flange of the lower panel for relative movement in the plane of the second leg portion of the top flange of the lower panel.

The second leg portion of the top flange of the lower panel extends upwardly behind and a substantial distance above the bottom flange of the adjacent panel above it to form a barrier against intrusion of water at the horizontal juncture between the two panels. A drainage gutter extends along the vertical juncture between each pair of laterally adjacent panels and closely underlies the edges of the side flanges of the adjacent panel.

In one embodiment of the invention, the top flanges of the panels are affixed to the building structure, either directly or to a horizontal retainer that, in turn, is affixed to the building structure, by means of one or more brackets attached to the top flange. The bottom flange of each panel is affixed to the top flange of the adjacent panel below it by means of one or more clips fastened to the bottom flange and having an inverted U-shaped portion received over the second leg of the top flange of the lower panel and constituting a slip joint that allows movement of the lower flange of the upper panel relative to the top flange of the lower panel due to thermal expansion and contraction.

In another embodiment of the invention, the bottom flange is affixed to the building structure by one or more clips that have an inverted U-shaped portion received over the second leg of the top flange of the lower panel and constituting a slip joint that affords movement of the top flange of the lower panel due to thermal expansion and contraction and a flange portion depending from the U-shaped portion and adapted to be fastened to the building structure.

In accordance with a preferred feature of the present invention, a gap is left between the front face of the second leg of the top flange of the lower panel of each vertically adjacent pair of panels and the edge of the bottom flange of the upper panel of the pair so that air can pass through the gap to provide equalization of pressure between the ambient air externally of the panels and the regions behind the principal walls of the panels. Similarly, gaps are left between the edges of the side flanges of each panel and the drainage gutter for communication of air between the ambient air externally of the panels and the zones between the principal walls of the panels and the building structure.

In a panel wall system according to the present invention, it is desirable to provide sealing elements between the side flanges of some of the drainage gutters and the side flanges of the panels associated with those drainage gutters. Incorporation of such sealing elements at approximately 20 foot intervals creates sealed zones for prevention of air circulation between zones that might otherwise cause a loss of pressure in some areas of the panel walls and reduce the effectiveness of the rain screen function of minimizing water intrusion due to differential pressure between the exteriors of the panels and the region between the panels and the building structure.

For a better understanding of the invention reference may be made to the following description of examplary embodiments, taken in conjuction with the figures of the accompanying drawings.

DESCRIPTION OF THE EMBODIMENT

Figure 1:
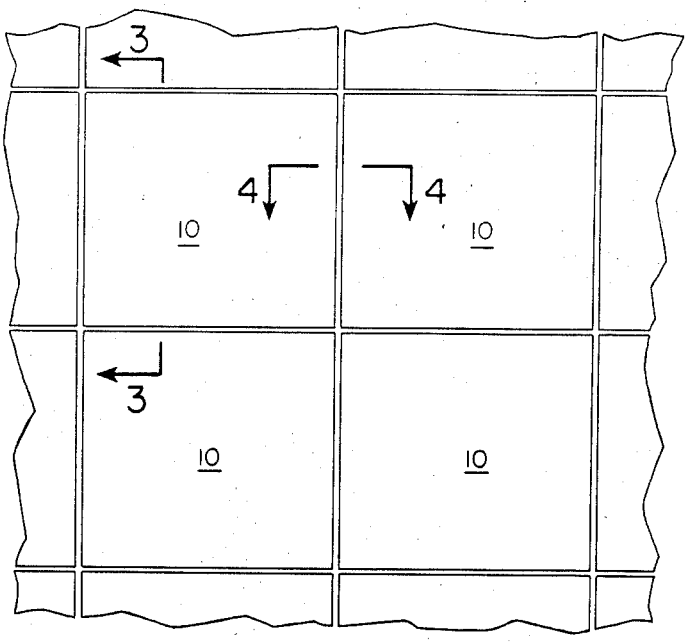
FIG. 1 is a generally schematic front elevational view of a cluster of panels embodying the panel assembly of the present invention.

FIG. 1 of the drawings shows schematically a typical cluster of panels 10 making up a planar section of an exterior building wall. The panels shown in the drawings are representative of the design concept of the present invention, but it will be understood by those skilled in the art that a complete building facing system will usually include special details at various locations of the building facade, such as window sill treatments, soffits, window heads and the like. These special treatments are not part of the invention disclosed and claimed in this application, and it is the intent of the present application to cover merely a typical assembly of panels that make up part of a panel wall assembly used in conjunction with special details of the type referred to.

The special details used in conjunction with the present invention will preferably be based on the concepts disclosed herein that provide for fixation of an upper or lower flange of a panel to the building structure, a slip joint connection between the upper or the lower flange of a panel and an element of the building adjacent to that flange, no connection at the vertical junctures between panels and the use of a drainage gutter along each vertical juncture between a vertical flange of a panel and an adjacent element. In some elements of special treatments, sealants or gaskets will be used for exclusion of water. This will generally be the case at junctures between panels and window frames, for example.

Figure 2:
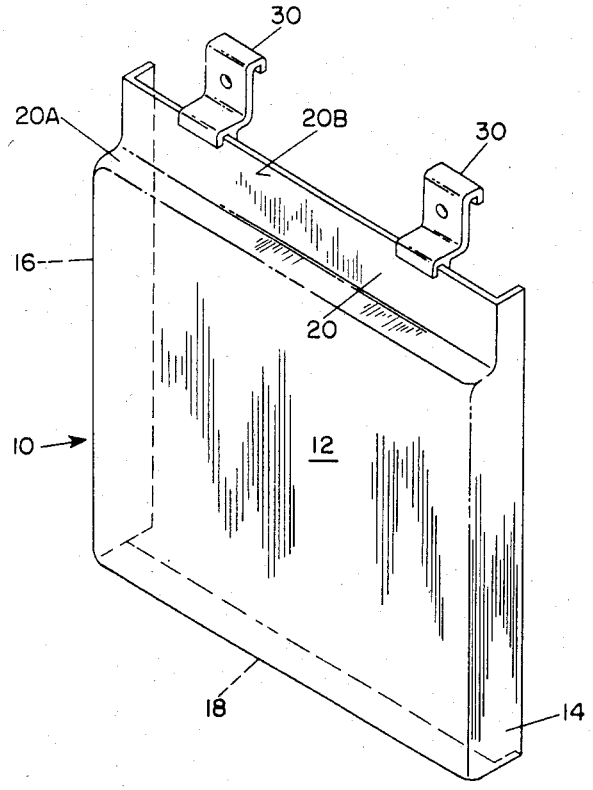
FIG. 2 is a pictorial view of a typical panel and brackets for connecting the top edge to a horizontal retainer, the brackets for the lower edge of the panel being omitted for clarity.

FIG. 1 of the drawings is intended primarily for orientation and to illustrate that the invention comprises rectangular panels 10 arranged side by side in rows and end to end in columns in closely spaced relation. A typical panel 10, as shown in FIG. 2, comprises a rectangular principal wall 12, side flanges 14 and 16 along each side edge of the principal wall extending toward the building structure, a bottom flange 18 along the bottom edge of the principal wall extending toward the building structure and a generally L-shaped top flange 20 extending along the upper edge of the principal wall and including a first leg portion 20A extending from the principal wall toward the building structure and a second leg portion 20B extending upwardly from the first leg portion.

Figure 3:
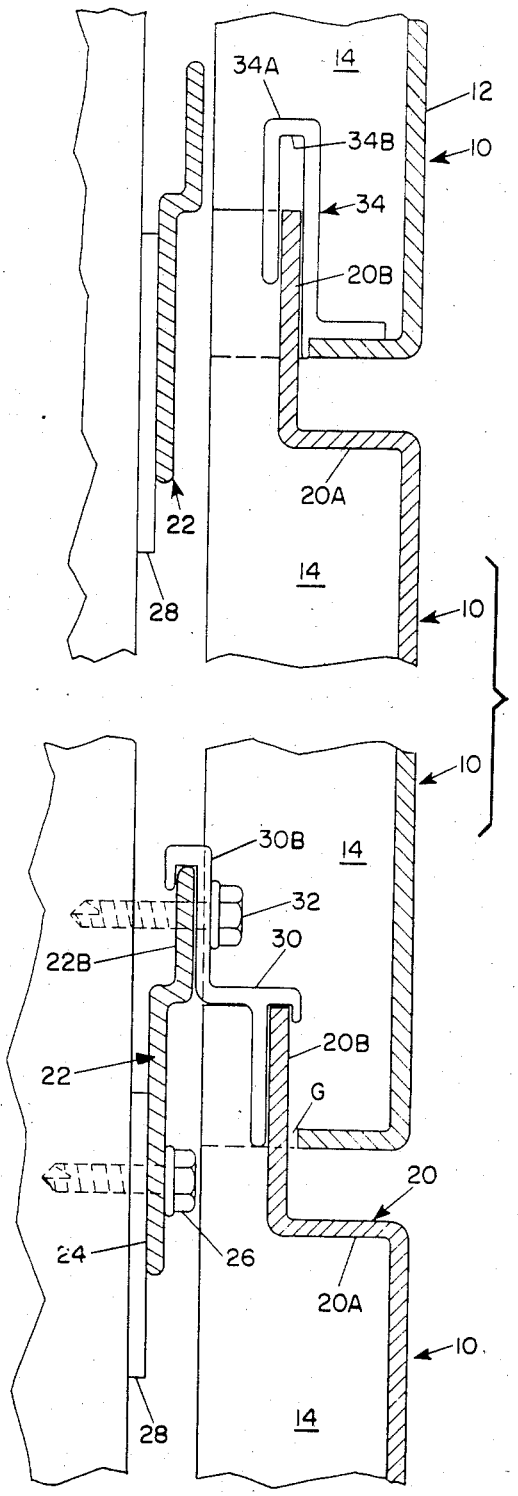
FIG. 3 is a side cross-sectional view of a portion of the panel group shown in FIG. 1, a segment of the panel being broken away and the view being taken generally along the plane represented by the arrowed lines 3—3 in FIG. 1.

As shown on the lower part of FIG. 3, the upper edge of each panel 10 is fastened to the building structure by a Z-shaped horizontal retainer 22 having a first leg portion 24 that is fastened by screws 26 to suitable elements of the building structure, shims 28 being installed as required to make the retainer 22 straight and true. The retainer 22 is preferred but not essential. Brackets 30 are welded or otherwise suitably fastened at intervals to the upwardly extending leg portion 20B of the upper flange 20 of the panel. The inverted generally "J"-shaped upper leg portion 30B of the bracket facilitates installation by allowing the panel to the hung in place on the retainer 22 until the self-tapping, self-drilling screws 32 are installed to join the bracket 30 to the upper leg portion 22B of the retainer. For clarity, the lower portion of FIG. 3 does not depict the way in which the lower edge of the upper panel at the juncture shown is joined to the lower panel of the pair. Instead, this is depicted in the upper portion of FIG. 3. Similarly the upper portion of FIG. 3 does not show the fastening arrangement for joining the lower panel at this juncture to the bracket, because this is shown in the lower portion of FIG. 3.

Referring now to the upper part of FIG. 3, the lower edge of each panel is joined to the upper edge of the panel below it by one or more clips 34 that are suitably joined, such as by welding, to the lower flange 18 of the panel. Each clip 34 comprises an inverted U-shaped leg portion 34A that defines a downwardly open slot 34B that accepts the upper portion of the upwardly extending leg portion 20B of the panel below it. The dimensional relationship between the leg portion 20B and the slot 34B of the clip 34 is such as to provide a slip joint between the respective clips and the leg portions 20B, thereby to accommodate movement due to thermal expansion and contraction of the lower end of each panel, relative to the fixed upper end of the panel below it. It will be apparent that the brackets 30 have to be staggered relative to the clips 34.

As best shown in the lower portion of FIG. 3, there is a gap G between the free end of the lower flange 18 of each panel and the outer face of the leg portion 20B of the adjacent panel below it. The gap serves two purposes; first it allows equalization of the air pressures between the face of the building external of the principal walls 12 and the region between the building structure and the inner panel faces. Such equalization of air pressure minimizes the tendency for water to be blown into the space between the building structure and the panel face, a concept that is generally known and often referred to as the "rain screen" principle. Secondly, the gap allows any water that does intrude between the building structure and the inner panel faces to drain out.

Figure 4:
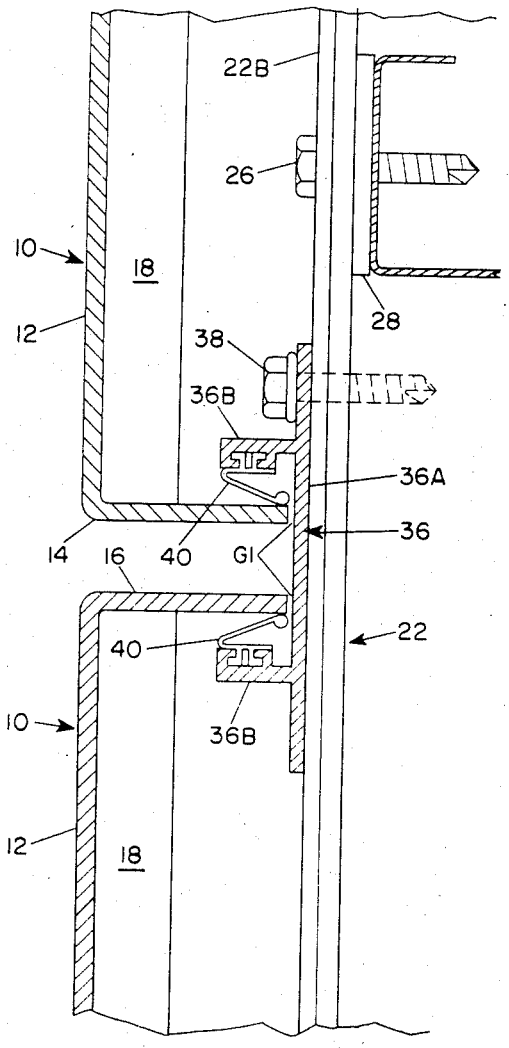
FIG. 4 is a top cross-sectional view of the juncture between laterally adjacent panels, as indicated by the arrowed lines 4—4 in FIG. 1.

Referring to FIG. 4, a drainage gutter 36 extends along the vertical juncture between laterally adjacent panels. The drainage gutter 36 comprises a base portion 36A and a pair of spaced apart flanges 36B extending outwardly from the base portion 36 and straddling the adjacent side flanges 14 and 16 of the adjacent panels. Self-drilling, self-tapping screws 38 are used to fasten the drainage channel to the offset leg portion 22B of each horizontal retainer which the drainage gutter traverses. The drainage gutter extends continuously along all vertical joints between adjacent vertical columns of panels. It will be observed in FIG. 3 that there is ample space inwardly toward the building structure from the upper leg 20B of the upper flange of each panel and the inner extremity of the lower flange 18 of each panel for each drainage gutter to extend continuously.

V-shaped sealing elements 40 are provided between the side flanges 36B of the drainage gutter 36 and the panel flanges 14 and 16. Preferably, the sealing elements 40 are not used on all of the drainage gutters, but it is desirable to have them at approximately 20 ft. intervals, thereby to create sealed zones and prevent loss of pressure that might otherwise occur at different areas of the walls and reduce the effectiveness of the rain screen function of minimizing water intrusion due to differential pressure between the exterior faces of the panels and the region between the panels and the building structure. Along the vertical junctures between laterally adjacent panels where the seals are omitted, gaps G1 are provided between the edges of the side flanges of the panels and the base portion 36A of the gutter 36 to allow air to enter relatively freely behind the panels to minimize water intrusion (see FIG. 4).

Figure 5:
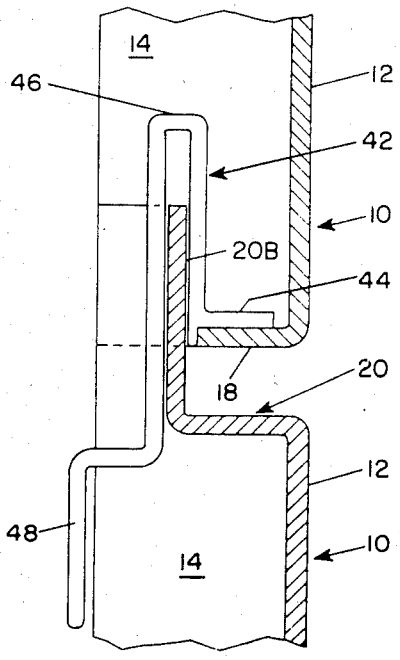
FIG. 5 is a side view of a clip for joining the panels to the building structure, according to another embodiment of the present invention.

In another embodiment of the invention, as shown in FIG. 5, panels of the same construction as those shown in FIGS. 2 to 4 are fastened to the building structure by clips 42. Each clip 42 includes a generally L-shaped front flange portion 44 that is welded or otherwise suitably fastened to the bottom flange 18 of each panel 10. An inverted U-shaped portion 46 receives the vertical leg portion 20B of the adjacent panel for relative movement in the plane of the leg 20B. A flange portion 48 depends from the U-shaped portion 46 and is fastened to the building structure or to a horizontal retainer by a screw (not shown).

A panel wall assembly embodying the present invention is easy to fabricate and install and can therefore be supplied at relatively low cost. It provides an effective, durable and attractive exterior surface for building walls. The panels can be fabricated from various materials, but it is preferred to make the panels from ⅛" thick aluminum sheet cut into blanks, bent to form side and top and bottom flanges and welded along the corners. The retainers and drainage gutters can be produced from aluminum by extrusion. Likewise the clips can be produced from aluminum extrusions cut to the desired length.

This construction of the panel assembly is such that the spaces between the building structure and the principal walls of the panels communicate relatively freely with the ambient air, thereby permitting the pressure between the ambient air and the aforementioned zones to equalize. This minimizes the intrusion of water. The drainage gutters capture wind blown rain that intrudes in the gaps at the vertical junctures between the panels and carry the water to the bottom of the panel array where it may be further collected and conducted away in any suitable manner. The upwardly extending leg 20B of the top flange of each panel, which extends a substantial distance above the bottom flange 18 of the panel above it, blocks the entry of water into the space between the principal walls of the panels and the building structure. Condensate and any water that might intrude at the horizontal junctures between panels will simply flow down into the gaps and run down the outer surfaces of the panels.

In the event of damage to a panel in a wall system, it is relatively simple to remove the panels in the vertical column that contains the damaged panel. In the case of the embodiment of FIGS. 2 to 4, panels are removed by starting with the uppermost panel in a column of adjacent panels and removing the panels down to and including the damaged one. A new panel can be installed and the panels above are reinstalled. In the case of the embodiment of FIG. 5, damaged panels are replaced by removing the vertical column beginning with the bottom panel and working up to and including the damaged panel.

I claim:

1. A building panel wall assembly comprising a multiplicity of pan-like rectangular panels arranged side by side and end to end in closely spaced-apart relation, each panel having a principal wall constituting a portion of the exterior building wall, a side flange along each side edge of the principal wall extending toward the building structure, a bottom flange along the bottom edge of the principal wall extending toward the building structure, and a generally L-shaped top flange along the upper edge of the principal wall and including a first leg portion extending from the principal wall toward the building structure and a second leg portion extending upwardly from the first leg portion, affixation means at the horizontal juncture between each pair of vertically adjacent panels for affixing either the top flange of the lower panel of the pair or the bottom flange of the upper panel of the pair to the building structure, slip joint means for joining the bottom flange of each panel to the top flange of the adjacent panel below it for relative movement of said top and bottom flanges in the plane of the second leg portion, the second leg portion of the top flange of each panel extending upwardly behind and a substantial distance above the bottom flange of the adjacent panel above it to form a barrier against intrusion of water at the horizontal junctures between panels, and a drainage gutter mounted to the building and extending along the vertical juncture between each pair of laterally adjacent panels and closely underlying the edges of the spaced-apart flanges of a pair of horizontally adjacent panels.

2. An assembly according to claim 1 wherein the affixation means includes at least one bracket attached to the top flange of the lower panel of the pair and adapted to be fastened to the building structure.

3. An assembly according to claim 2 wherein the affixation means further includes a horizontal retainer adapted to be affixed to the building structure at each horizontal juncture between vertically adjacent panels and wherein the brackets are fastened to the horizontal retainers.

4. A building panel wall assembly comprising a multiplicity of pan-like rectangular panels arranged side by side and end to end in closely space-apart relation, each panel having a principal wall constituting a portion of the building wall, a side flange along each side edge of the principal wall extending toward the building structure, a bottom flange along the bottom edge of the principal wall extending toward the building structure, and a generally L-shaped top flange along the upper edge of the principal wall and including a first leg portion extending from the principal wall toward the building structure and a second leg portion extending upwardly from the first leg portion and affixation means at the horizontal juncture between each pair of vertically adjacent panels for affixing either the top flange of the lower panel of the pair or the bottom flange of the upper panel of the pair to the building structure and for joining the bottom flange of each panel to the top flange of the adjacent panel below it for relative movement of said top and bottom flanges in the plane of the second leg portion, the second leg portion of the top flang of each panel extending upwardly behind and a substantial distance above the bottom flange of the adjacent panel above it to form a barrier against intrusion of water at the horizontal junctures between panels, said affixation means being further characterized in that it includes at least one bracket attached to the top flange of the lower panel of the pair and adapted to be fastened to the building structure and at least one clip fastened to the bottom flange of the upper panel of the pair and having an inverted U-shaped portion received over the second leg of the top flange of the lower panel of the pair and constituting a slip joint that affords said relative movement.

5. An assembly according to claim 4 wherein the clip is adapted to provide a gap between the second leg of the top flange of the lower panel and the edge of the bottom flange of the upper panel of the corresponding pair of vertically adjacent panels, whereby air can pass through to provide equalization of pressure between the ambient air and the regions behind the principal walls of the panels.

6. An assembly according to claim 1 wherein the affixation means includes at least one clip affixed to the bottom flange of the upper panel of the pair and having an inverted U-shaped portion received over the second leg of the top flange of the lower panel of the pair and constituting a slip joint that affords said relative movement and a flange portion depending from the U-shaped portion and adapted to be fastened to the building structure.

7. An assembly according to claim 1 and further comprising sealing means interposed between at lease some of the drainage gutters and the corresponding side flanges of the laterally adjacent panels for confining water intruding at the vertical juncture between panels to the space bounded by the side flanges and the drainage gutter.

8. An assembly according to claim 4 wherein the clip is adapted to provide a gap between the second leg of the top flange of the lower panel and the edge of the bottom flange of the upper panel of the corresponding pair of vertically adjacent panels, whereby air can pass through to provide equalization of pressure between the ambient air and the regions behind the principal walls of the panels.

9. An assembly according to claim 4, including a drainage gutter mounted to the building and extending along the vertical juncture between each pair of laterally adjacent panels and closely underlying the edges of the side flanges.

* * * * *